US010164349B2

(12) United States Patent
Koellmann

(10) Patent No.: US 10,164,349 B2
(45) Date of Patent: Dec. 25, 2018

(54) CONNECTION TERMINAL HAVING AT LEAST TWO SPRING-FORCE CLAMPING CONNECTIONS

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 15/974,119

(22) Filed: May 8, 2018

(65) Prior Publication Data

US 2018/0254568 A1 Sep. 6, 2018

Related U.S. Application Data

(63) Continuation of application No. PCT/EP2016/076973, filed on Nov. 18, 2016.

(30) Foreign Application Priority Data

Nov. 9, 2015 (DE) ..... 10 2015 119 247

(51) Int. Cl.
*H01R 11/09* (2006.01)
*H01R 4/48* (2006.01)
(Continued)

(52) U.S. Cl.
CPC ..... *H01R 4/4836* (2013.01); *H01R 9/2608* (2013.01); *H01R 9/2675* (2013.01); *H01R 4/4818* (2013.01); *H01R 2107/00* (2013.01)

(58) Field of Classification Search
None
See application file for complete search history.

(56) References Cited

U.S. PATENT DOCUMENTS 7,833,047 B2 * 11/2010 Pizzi ..... H01R 4/4827 439/395
8,794,994 B2 * 8/2014 Kollmann ..... H01R 4/4836 439/441

(Continued)

FOREIGN PATENT DOCUMENTS

EP 2605335 A2 6/2013

OTHER PUBLICATIONS

International Search Report dated Dec. 13, 2016 in corresponding application PCT/EP2016/076973.

(Continued)

*Primary Examiner* — Tho D Ta
(74) *Attorney, Agent, or Firm* — Muncy, Geissler, Olds & Lowe, P.C.

(57) ABSTRACT

A connection clamp for connecting at least two electrical conductors to one another, having an insulating housing with at least one first and one second conductor insertion opening that are arranged on mutually opposite sides of the insulating housing. A first spring-force clamping connection for electrically contacting a first electrical conductor inserted through the first conductor insertion opening and a second spring-force clamping connection for electrically contacting a second electrical conductor inserted through the second conductor insertion opening are provided. The first spring-force clamping connection is electrically connected to the second spring-force clamping connection via a bus bar. The first spring-force clamping connection has at least one first clamping spring for clamping the first electrical conductor against a first clamping point of the bus bar, the second spring-force clamping connection has a clamping leg for clamping the second electrical conductor against a second clamping point of the bus bar.

12 Claims, 8 Drawing Sheets

(51) Int. Cl.
*H01R 9/26* (2006.01)
*H01R 107/00* (2006.01)

(56) References Cited

U.S. PATENT DOCUMENTS 8,998,634 B2 * 4/2015 Koellmann ..... H01R 9/26
439/441
9,124,034 B2 9/2015 Köllmann
9,413,085 B2 * 8/2016 Hoppmann ..... H01R 4/4836

OTHER PUBLICATIONS

English Translation of International Preliminary Report on Patentability dated May 24, 2018 in corresponding application PCT/EP2016/076973.

* cited by examiner

CONNECTION TERMINAL HAVING AT LEAST TWO SPRING-FORCE CLAMPING CONNECTIONS

This nonprovisional application is a continuation of International Application No. PCT/EP2016/076973, which was filed on Nov. 8, 2016, and which claims priority to German Patent Application No. DE10 2015 119 247.0, which was filed in Germany on Nov. 9, 2015, and which are both herein incorporated by reference.

BACKGROUND OF THE INVENTION

Field of the Invention

The present invention relates to a connecting terminal for connecting at least two electrical conductors to one another, having: the connecting terminal comprises an insulating housing with at least one first and one second conductor insertion opening; the first and the second conductor insertion openings are arranged on mutually opposite sides of the insulating housing; a first spring-force clamping connection for making electrical contact with a first electrical conductor, which is inserted through the first conductor insertion opening, and a second spring-force clamping connection for making electrical contact with a second electrical conductor, which is inserted through the second conductor insertion opening, are arranged in the insulating housing; the first spring-force clamping connection is electrically connected to the second spring-force clamping connection by means of a bus bar; the first spring-force clamping connection comprises at least one first clamping spring which has a clamping leg for clamping the first electrical conductor against a first clamping point of the bus bar, and a bearing leg for supporting the clamping spring; the second spring-force clamping connection comprises at least one second clamping spring which has a clamping leg for clamping the second electrical conductor against a second clamping point of the bus bar, and a bearing leg for supporting the second clamping spring; and/or the bus bar has at least one through-opening which is arranged between the first and second clamping points.

Description of the Background Art

Connecting terminals with conductor insertion openings arranged on mutually opposite sides of the housing, which are also referred to as dual connecting terminals or double sided connecting terminals, for example, are known from DE 10 2013 101 830 A1, which is incorporated herein by reference.

SUMMARY OF THE INVENTION

It is an object of the present invention to provide a more compact connecting terminal.

In an exemplary embodiment, this object is achieved by a connecting terminal in that an extended end section of the bearing leg of the first and/or the second clamping spring is hooked into the through-opening of the bus bar. In this way, a particularly compact bus bar can be used for securing the first and/or second clamping spring. This way, at the same time, forces of the first and/or second clamping spring acting on the insulating housing can be reduced to an acceptable magnitude.

A further advantage of the invention is that the first and the second clamping springs can be arranged closer to one another and can also touch each other, which opens up the possibility of designing the bus bar shorter than in known connecting terminals. This can save in material on the bus bar. In addition, the connecting terminal can be constructed shorter in the longitudinal direction of the bus bar.

Overall, this allows for the connecting terminal to be constructed particularly flat.

A further advantage is that the bus bar can be constructed as a flat component, minimizing material and manufacturing costs of the bus bar and also benefitting a generally flat construction design of the connecting terminal. The through-opening of the bus bar may in particular have a non-circular shape in a plan view of the bus bar, for example, rectangular or, optionally, with rounded corner areas. This improves the hook-attachment of the first and/or second clamping spring on the bus bar.

Advantageously, the respective extended end sections of the bearing legs of the first and the second clamping springs may thus be hooked into one and the same through-opening of the bus bar. In this manner, the bus bar need not have a plurality of openings, so that mechanical weakening of the bus bar as well as deterioration of the electrical conductivity can be minimized.

The connecting terminal can be implemented as a single-pole connecting terminal, i.e., with only one bus bar, or as a multi-pole connecting terminal, for example, in that a plurality of individual connecting terminals are lined up next to each other so that their bus bars are arranged substantially parallel to each other. The multi-pole connecting terminal can, for example, be formed as a separable connecting terminal which the user can customize to the desired number of poles.

The connecting terminal can comprise a first operating lever for opening and closing the first spring-force clamping connection by acting on the clamping leg of the first clamping spring once the first operating lever has been actuated and/or a second operating lever for opening and closing the second spring-force clamping connection by acting on the clamping leg of the second clamping spring once the second operating lever has been actuated. This has the advantage that the first spring-force clamping connection or the second spring-force clamping connection can be operated without additional tools. The hereby proposed lever operation makes the connecting terminal more user-friendly and easier to operate.

The first and/or the second clamping spring can be formed in a loop shape, wherein in an extended end section of the respective clamping spring, the respective bearing leg is bent in the direction of the bus bar. This has the advantage that with an integrally formed clamping spring, which for example may be formed as a stamped and bent part, the functionality of the spring-force clamping connection described above, as well as the mounting of the clamping spring, can be realized within the connecting terminal.

The first clamping spring can touch the second clamping spring in the region of their respective bearing leg. This has the advantage that the first and second clamping springs can support each other, i.e., the one clamping spring can absorb the pressure forces of the other clamping spring. Also, this allows for material savings and compact design of the connecting terminal. In addition, the stress of the insulating housing is minimized by spring forces, so that the insulating housing can be simplified.

The bearing leg of the first clamping spring can form a conductor stop during insertion of the first conductor into the insulating housing and/or the bearing leg of the second clamping spring forms a conductor stop for the second conductor during insertion into the insulating housing. This has the advantage that no additional measures for creating a conductor stop in the respective conductor insertion region of the connecting terminal are required, such as an insulating wall. Also, hereby the insulating housing can be optimized in terms of the necessary materials and construction. The conductor stop can, in particular, avoid over insertion of the conductor into the connecting terminal. A user can easily haptically recognize when a conductor is sufficiently deeply inserted into the connecting terminal. For example, the aforementioned region of the respective clamping spring bent towards the bus bar can serve as a conductor stop.

The through-opening in the bus bar can be formed as a bushing (material passage). The bushing may comprise, for example, a wall made of the material of the bus bar, which surrounds the through-opening and protrudes from the surface of the bus bar surrounding the through-opening. This has the advantage that the through-opening can be produced in a simple and reliable way. This also creates mechanical reinforcement of the bus bar in the area inherently weakened by the through-opening. The electrical characteristics of the bus bar are also improved.

A portion of the bearing leg of the first clamping spring, which is hooked into the through-opening, can engage behind the through-opening of the bus bar on the side of the bus bar facing away from the first clamping point and/or the portion of the bearing leg of the second clamping spring, which is hooked into the through-opening, engages behind the through-opening of the bus bar on the side of the bus bar facing away from the second clamping point. In this way, the first clamping spring and/or the second clamping spring located below the bus bar, i.e., on the side facing away from the respective clamping point, can be hooked therein and is securely held on the bus bar without any additional fixing mechanics. The portion of the bearing leg of each clamping spring hooked into the through-opening can, for example, engage behind the aforementioned wall of the bushing.

The bearing leg of the first clamping spring can be supported on the bus bar on the side facing the first clamping point and/or the bearing leg of the second clamping spring is supported on the bus bar on the side facing the second clamping point. In this way, the clamping spring can be fixed to the bus bar on the side of the bus bar on which it does not engage behind the through-opening, and be supported there safely. This can be realized for example in that the bearing leg of each clamping spring located in the region in which the support is provided on the bus bar has a greater width than the through-opening.

The first and/or the second clamping spring may for example comprise a resilient arc via which the bearing leg is connected to the clamping leg. The clamping spring may, for example, be generally V-shaped, for example, in a sort of loop shape.

The first clamping spring and/or the second clamping spring can be supported on the insulating housing. In this way, the clamping spring can also be fixed in the insulating housing, for example, in the bearing leg area, which adjoins a resilient arc of the clamping spring via which the bearing leg is connected to the clamping leg.

The connecting terminal can comprise a plurality of adjacently arranged conductor insertion openings on a respective housing side of the insulating housing, which each have spring-force clamping connections with a clamping spring that is associated with a conductor insertion opening, wherein extended end sections of clamping springs, which are arranged side by side, are hooked in the same through-opening of the bus bar. Such a connecting terminal having a plurality of conductor insertion openings arranged adjacent to one another on a housing side of the insulating housing can also be termed a dual connecting terminal (two adjacently arranged conductor insertion openings) or a multiclamp terminal (more than two adjacently arranged conductor insertion openings). The described further development of the invention can minimize the number of through-openings in the bus bar necessary for attaching the clamping springs so that weakening and deterioration of the electrical properties of the bus bar can also be minimized.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
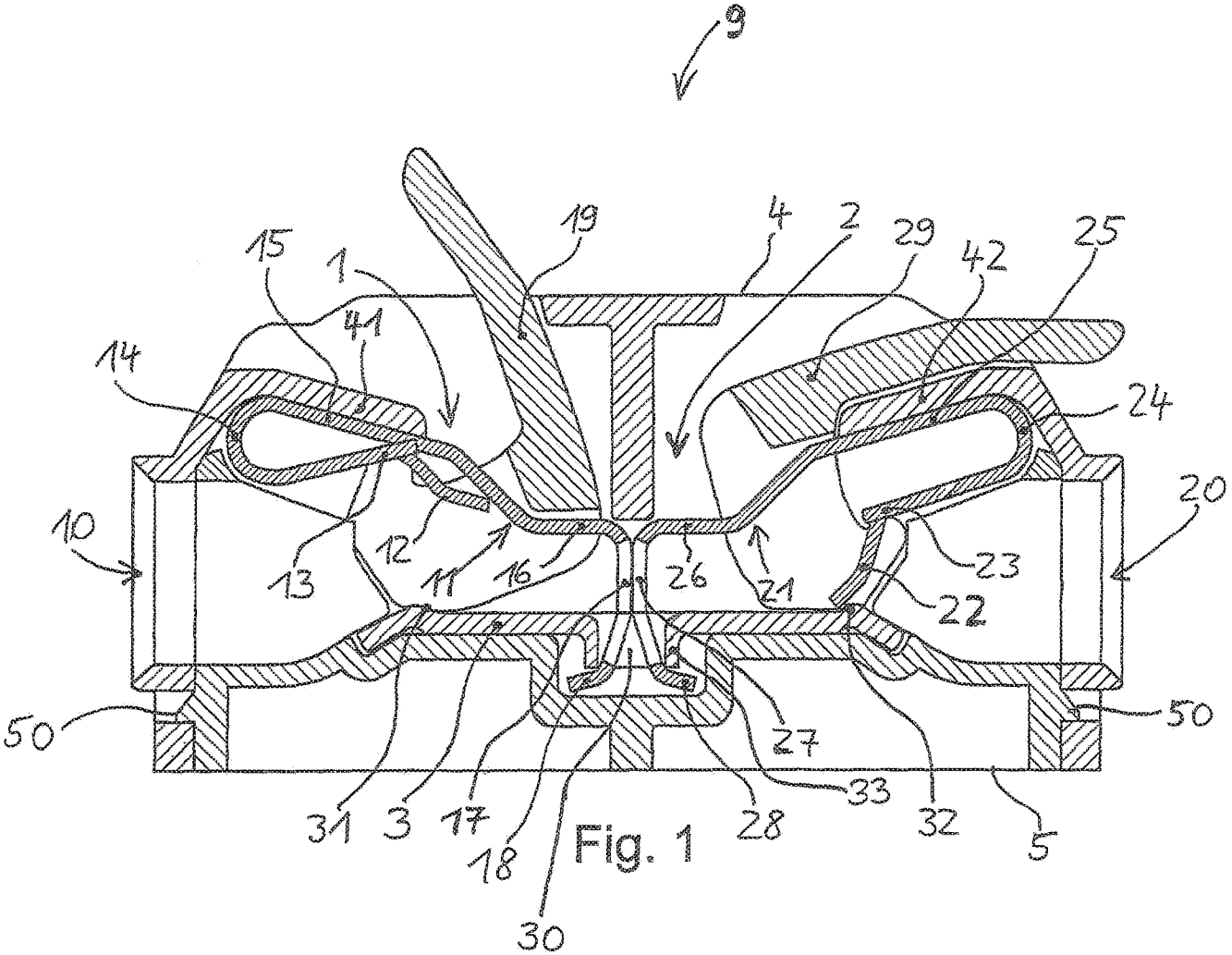
FIG. 1 is a side sectional view of a connecting terminal.

The connecting terminal 9 shown in FIG. 1 is constructed substantially symmetrical with respect to a vertical symmetry axis. It has a first spring-force clamping connection 1 and a second spring-force clamping connection 2, in each case to the left and right of the vertical axis of symmetry. The first and second spring-force clamping connection 1, 2 are arranged in an insulating housing 4, 5 of the connecting terminal 9. The insulating housing 4, 5, for example, may be formed in at least two parts, for example an upper housing part 4 and a bottom part 5 which are connected by locking elements 50 to the upper housing part 4.

The first spring-force clamping connection 1 has a loop shaped first clamping spring 11 with multiple bends. The first clamping spring 11 has a clamping leg 12 at one end, which serves to clamp an electrical conductor, which is inserted through a first conductor insertion opening 10, against a first clamping point 31 of a bus bar 3. In the region of the clamping leg 12, a loading region 13 of the first clamping spring 11 is provided, in which the clamping leg 12 can be operated via an operating lever 19 for opening and closing the first spring-force clamping connection 1.

A resilient arc 14 connects to the clamping leg 12 of the first clamping spring 11, to which a bearing leg 15 of the first clamping spring 11 is then connected. The bearing leg 15 rests on an inner wall portion 41 of the insulating housing 4, 5 and is supported thereon at least partially against the forces captured by the clamping leg 12. The first clamping spring 11 continues to extend in the region of the bearing leg 15 into an extended end section 16, in which the material of the first clamping spring 11 is ultimately bent in a vertical portion 17 in the direction of the bus bar 3. The end section 16 of the bearing leg 15 extends further down beyond the vertical section 17 through a through-opening 30 of the bus bar 3 and is then hooked into the through-opening 30 of the bus bar 3, for example, by further bending an end piece 18 of the end portion 16, which thus engages behind the bus bar 3, in particular in a region of the bus bar 3 formed as a bushing 33, which surrounds the through-opening 30 in the shape of a socket.

The second clamping spring 21, for example, may also be shaped like the first clamping spring 11. For this purpose, it is provided that the second spring-force clamping connection 2 has a loop-shaped multi-angled second clamping spring 21. The second clamping spring 21 has a clamping leg 22 at one end which serves to clamp an electrical conductor, which is inserted through a second conductor insertion opening 20, against a second clamping point 32 of the bus bar 3. In the region of the clamping leg 22, a loading region 23 of the second clamping spring 21 is provided, on which the clamping leg 22 can be operated via an operating lever 29 for opening and closing the second spring-force clamping connection 2.

A resilient arc 24 connects to the clamping leg 22 of the second clamping spring 21, to which a bearing leg 25 of the second clamping spring 21 is connected. The bearing leg 25 rests on an inner wall portion 42 of the insulating housing 4, 5 and is at least partially supported thereon against the forces captured by the clamping leg 22. The second clamping spring 21 further extends in the area of the bearing leg 25 into an extended end section 26 in which the material of the second clamping spring 21 is subsequently bent in a vertical portion 27 in the direction of the bus bar 3.

The end section 26 of the bearing leg 25 extends beyond the vertical portion 27, down further through the through-opening 30 of the bus bar 3, and is eventually hooked into the through-opening 30 of the bus bar 3, for example, with an end piece 28 of the end section 26 being further bent, thus engaging behind the bus bar 3, in particular in the area of the bus bar 3 formed as a bushing 33.

FIG. 1 shows the first spring-force clamping connection 1 with an open, first operating lever 19 in such a way that the first clamping point 31 is not touched by the clamping leg 12, so that an electric conductor possibly previously clamped there can be removed. It can be seen that the clamping leg 12 of the first clamping spring 11 is then removed from the first clamping point 31. The second spring-force clamping connection 2 is shown in the closed state, that is, the second operating lever 29 is in the closed position. In this state, the clamping leg 22 of the second clamping spring 21 touches the end of the second clamping point 32 of the bus bar 3.

It can also be seen that the bus bar 3 has indentations in the region of its first and second clamping points 31, 32, through which the material of the bus bar 3 slightly projects towards the top, i.e., in the direction of the respective clamping leg 12, 22. In this way, the clamping of a connected electrical conductor is improved.

The bus bar 3 is integrally formed as a flat, short bus bar piece. By configuring the through-opening 30 with the bushing 33, the bus bar 3 is mechanically stabilized in this area and also optimized in terms of electrical conduction.

The assembly of the connecting terminal 9 can be carried out, for example, as follows: the clamping springs 11, 21 are mounted on the bus bar 3; the clamping springs 11, 21 can be deflected with mandrels; the operating levers 19, 29 can be moved via the bearing legs 15, 25 to the bus bar 3 in a position corresponding to the closed position; the clamping springs 11, 21 are moved to a (fully) open position by pivoting the operating levers 19, 29; any mandrels used are retracted; the now pre-assembled unit with bus bar 3, clamping springs 11, 21 and operating levers 19, 29 (in the open position) is placed on the bottom part 5; the upper housing part 4 is slipped on; and the operating levers 19, 29 are pivoted to the closed position.

The clamping springs 11, 21 may initially, that is, before they are fixed to the bus bar 3, be not yet bent outwardly with their respective end sections 18, 28, as can be seen in FIG. 1. They may first substantially run in straight lines. After assembly of the clamping springs 11, 21 in the through-opening 30 of the bus bar 3, a further manufacturing step is carried out in that the end pieces 18, 28 are bent to the outside, i.e., in the direction of the respective conductor insertion opening 10, 20, and then engage behind the bushing 33.

The first clamping spring 11 is thereby supported in the vertical portion 17 on the vertical portion 27 of the second clamping spring 21, that is, the clamping springs 11, 21 are mutually supported in the area of their vertical portions 17, 27. The vertical portion 17 also forms a conductor stop during insertion of the first conductor into the insulating housing. The vertical portion 27 also forms a conductor stop during insertion of the second conductor into the insulating housing.

The connecting terminal 9 may be formed as a simple connecting terminal on which in each case one conductor insertion opening 10, 20 is present on each side. It can also be configured as a dual connecting terminal or a multiclamp terminal. In this case, two or more first conductor insertion openings 10 and two or more second conductor insertion openings 20 are arranged adjacent to each other on each side. For such embodiments, a different configuration of the respective operating lever 19, 29 can be advantageous.

Figure 2:
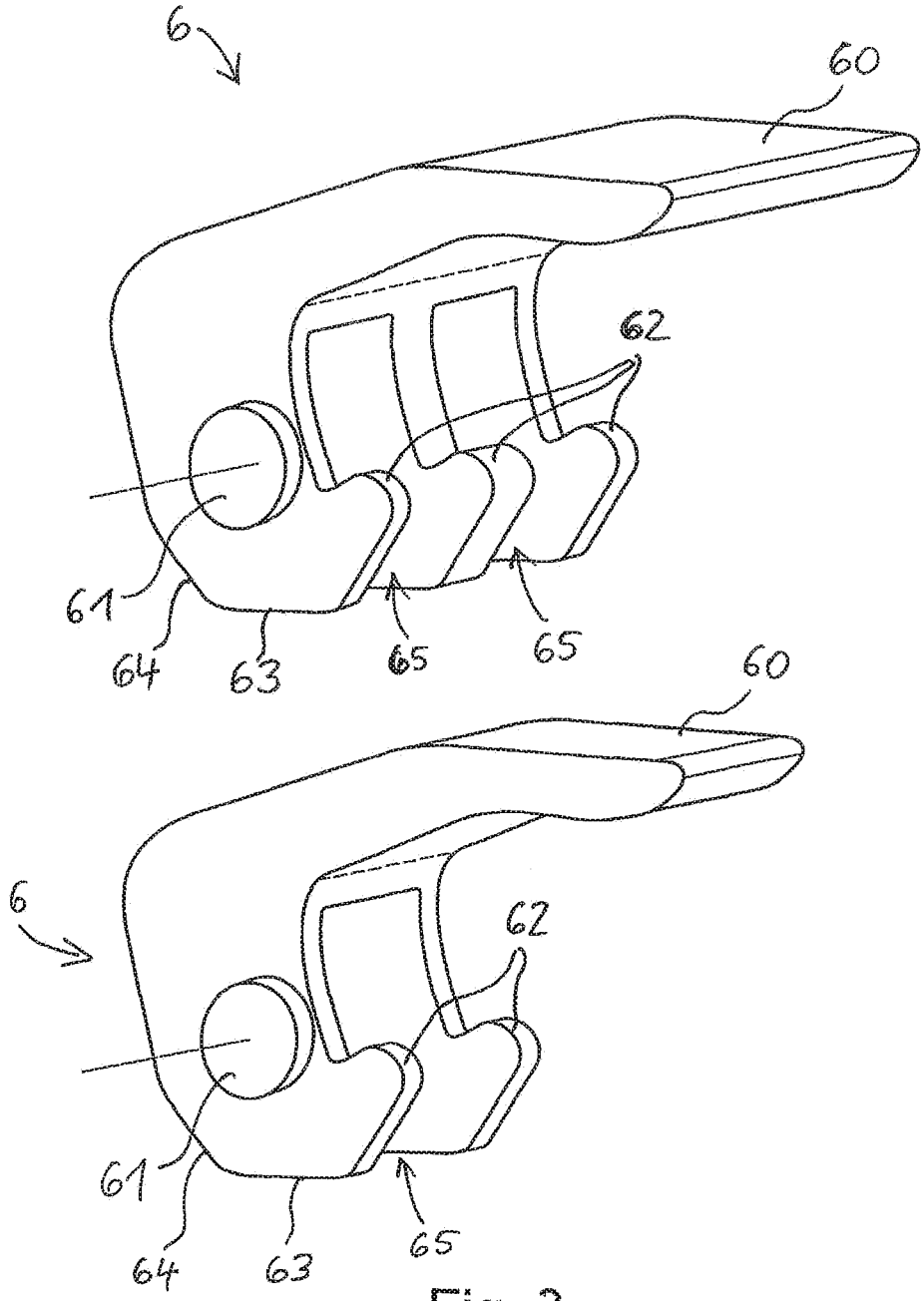
FIG. 2 illustrates operating levers of the connecting terminal.

In its lower area, FIG. 2 first shows an advantageous embodiment of an operating lever 6, which can be used as a first or second operating lever 19, 29, namely in the event that the connecting terminal only has one conductor insertion opening 10, 20 on either side. The operating lever 6 has a manual operating section 60 (handle portion) with which the operating lever 6 can be operated by a user. The operating lever 6 also has a bearing shaft 61, via which the insulating housing 4, 5 can be stored. The operating lever 6 is fork-shaped in the region of the bearing shaft 61, having a recessed area 65 in the center, with which the operating lever 6 can be pulled over the intermediate clamping spring. The clamping spring then has laterally protruding loading regions 13 and 23 on which the clamping spring can be acted upon on via operating regions 62 of the operating lever 6. A rear contour of the operating lever 6 has two angularly disposed bearing portions 63, 64 through which the operating lever is superimposed in the insulating housing and/or on the bus bar 3. In the closed operating position, the operating lever 6 is supported with the bearing portion 63; in the open position with the bearing portion 64. The bearing shaft 61 is received by a groove that is arranged in the upper housing part 4, which is substantially aligned perpendicular to the bus bar 3 in order to accommodate deflection occurring during the pivoting movement of the operating lever 19, 29, which is caused by the bearing portions 63, 64, which slide on the bus bar 3 during the pivoting movement of the operating lever 19, 29.

In its upper region, FIG. 2 shows an embodiment of an operating lever 6, which is adapted for a connecting terminal, in which two juxtaposed spring-force clamping connections are present on each side of the housing. Accordingly, the entire operating lever 6 is wider and has two adjacent, recessed portions 65 through which respective clamping springs can be passed. Correspondingly, three loading areas 62 are provided. Here, the center loading area 62 acts simultaneously on the two adjacent clamping springs on one side of the connecting terminal 9.

Figure 3:
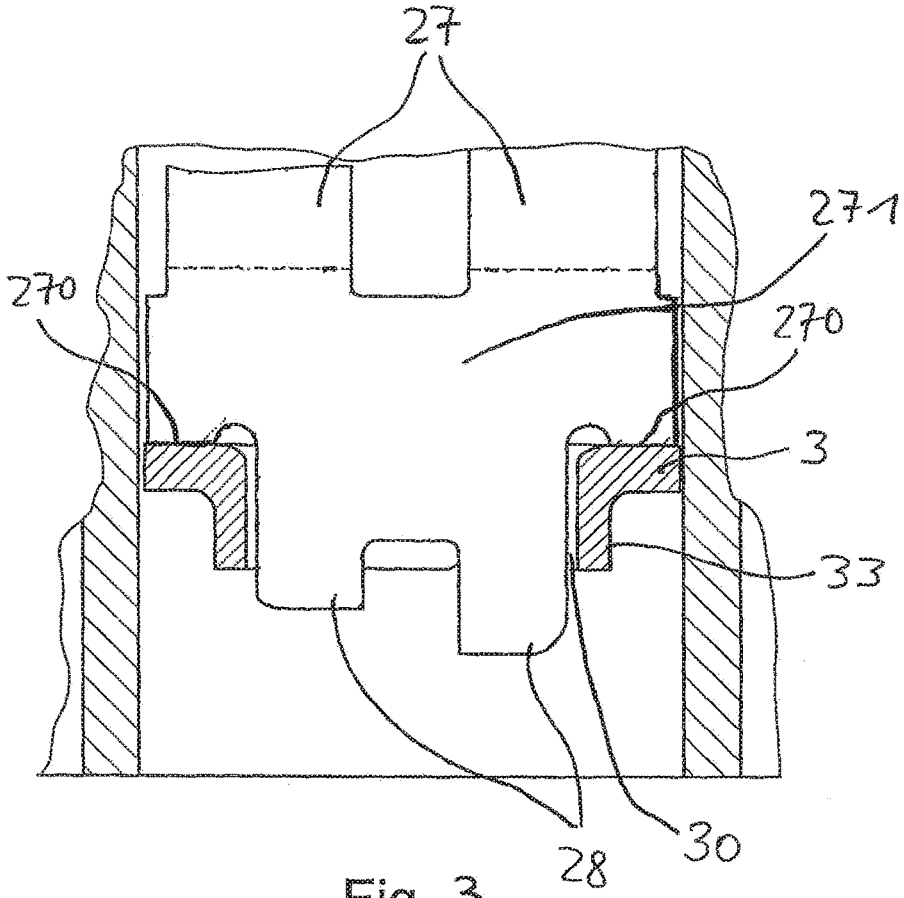
FIG. 3 is a detailed view of the connecting point between a clamping spring and the bus bar of the connecting terminal.

FIG. 3 shows an enlarged, detailed representation of the attachment of the clamping springs on the bus bar 3. By way of example, a dual clamping spring is shown which has two bearing legs and clamping legs extending side by side and is thus configured for a connecting terminal in which two adjacently arranged spring-force clamping connections are provided on each side of the housing. Shown here is a section of the respective vertical portions 27 of the clamping springs. These then combine to form a common mounting portion 271, which is finally secured on the bushing 33 of the bus bar 3 via the end pieces 28, which are guided through the through-opening 30. By way of example, the left end piece 28 is shown already bent, as shown in FIG. 1, and the right end piece 28 is not yet bent.

At the top of the bus bar 3, i.e., of the side of the bus bar 3 facing the respective clamping point 31, 32, the clamping spring rests with bearing surfaces 270 on the bus bar 3.

Figure 4:
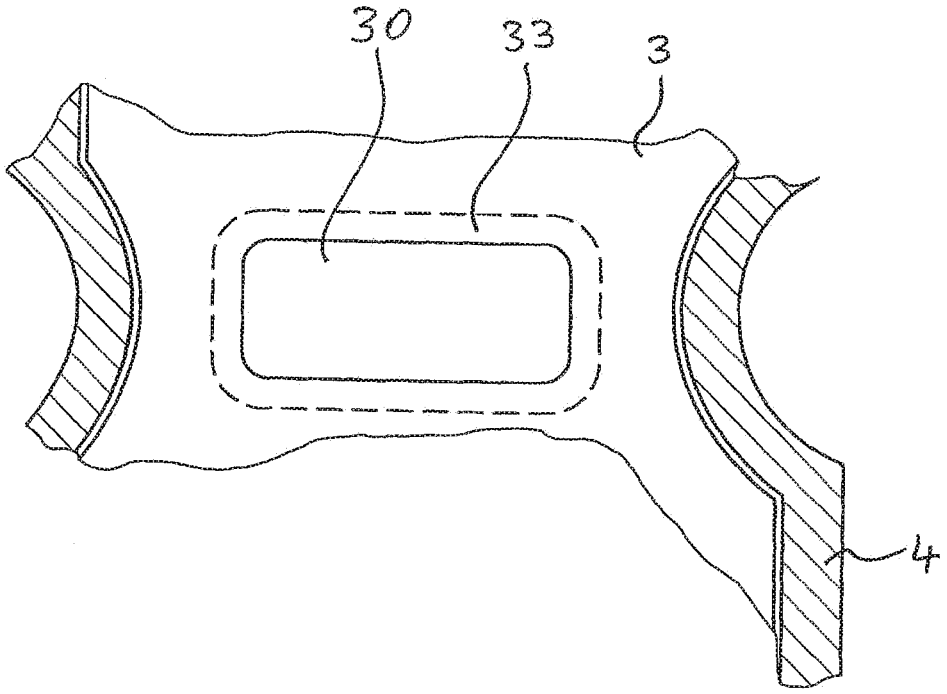
FIG. 4 is a detailed view of the bus bar of the connecting terminal in the area of the through-opening.

FIG. 4 shows an enlarged, detailed representation of a possible shape of the bus bar 3 in the area of the through-opening 30. The through-opening 30, for example, need not be circular, but may, as shown, be substantially rectangular in shape with rounded corners. Accordingly, the wall portion of the bushing 33 borders this through-opening 30.

The dual connecting terminal 9 according to FIGS. 5 to 9 corresponds in its essential structure to the connecting terminal 9 previously described with reference to FIGS. 1 to 4. Thus, primarily the differences will be discussed below.

Figure 5:
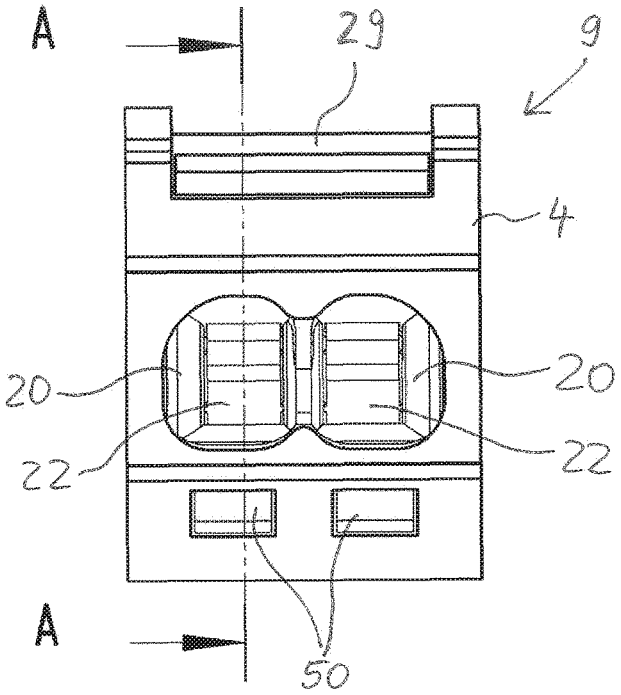
FIG. 5 is a view of the conductor insertion side of a dual connecting terminal.
Figure 6:
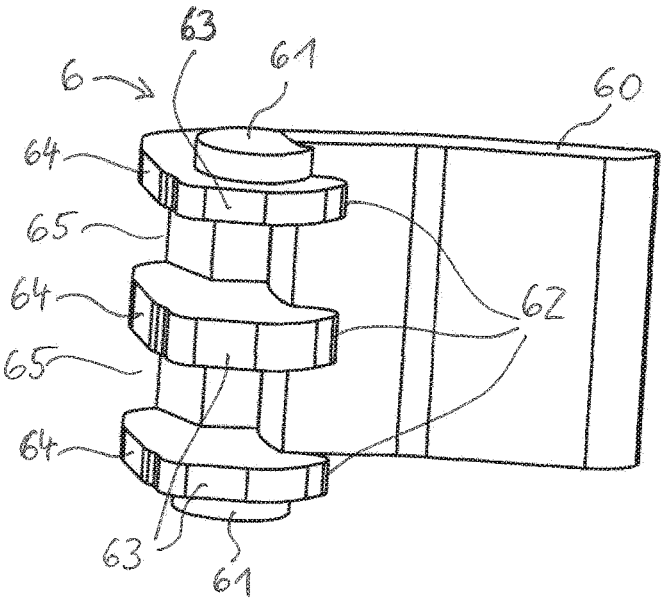
FIG. 6 is an operating lever for the dual connecting terminal according to FIG. 5 in a perspective view.

As shown in FIG. 5, each conductor insertion side of the dual connecting terminal 9 has in each case two adjacent conductor insertion openings 10, 20. In the closed position, for example, the clamping legs 22 are visible when looking into the conductor insertion openings 20. FIG. 6 shows a comparably formed operating lever 6, as shown in the upper figure of FIG. 2. The operating lever according to FIG. 6 can be applied as an operating lever 19 and 29, as shown in FIG. 7.

The bus bar 3 of the afore-described dual connecting terminal 9 also can have a through-opening 30, which, however, here can be formed without the bushing 33. Also in this embodiment, the vertical portions 17, 27 of the end sections 16, 26 of the clamping springs 11, 21 protrude through the through-opening 30. However, the vertical portions 17, 27 do not end in further angled end pieces 18, 28 in this example. Instead, they continue to run in straight end sections 71, 72 in the vertical direction. In order to fix the clamping springs 11, 21 in the opening 30 of the bus bar 3, the end pieces 71, 72 have respective material regions 73, 74 that project in the form of a latching tab or a barb. The material regions 73, 74 are resiliently deflected so that the clamping springs 11, 21 can be inserted with the end pieces 71, 72 through the openings 30 of the bus bar 3 in the illustrated back-to-back configuration. During the insertion, the material regions 73, 74 initially deflect. Once this plug-in operation has been performed, the material regions 73, 74 rebound and engage behind the bus bar 3, thus fixing the clamping springs 11, 21 on the bus bar 3.

Figure 7:
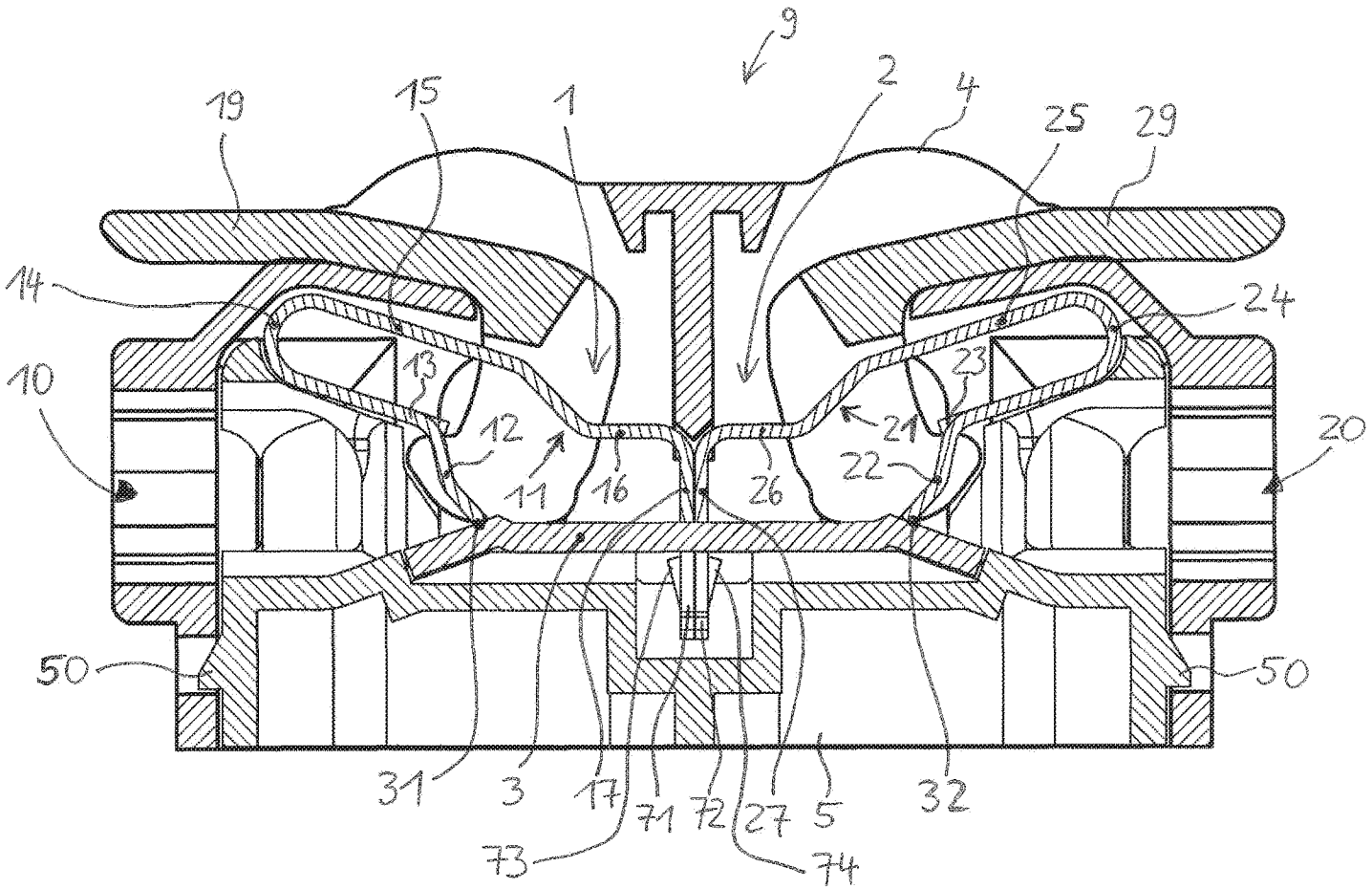
FIG. 7 is a sectional view according to section plane A-A depicted in FIG. 5 of the dual connecting terminal shown there.

As can be seen in FIG. 7, in this embodiment it is also not required that the bearing legs 15, 25 rest on or are supported on wall regions of the insulating housing 4, 5. Instead, the clamping springs 11, 21 can be constructed to be self-supporting.

Basically, it is possible that each clamping spring 11 has a separate end piece 71, 72 with a projecting material region 73, 74. With a single-pole connecting terminal, this is also required. In the presently described dual connecting terminal 9, this can also be realized in such a way that the clamping springs are formed independently from each other by means of their own end pieces 71, 72 with projecting material regions 73, 74 disposed thereon.

Alternatively, adjacent clamping springs situated side by side can also be designed via a common end piece 71 or 72, each having a projecting material region 73 or 74. In this case, the vertical portions 17, 27 may each be formed wider so that they continuously extend from one clamping spring to the other, adjacently arranged clamping spring.

Figure 8:
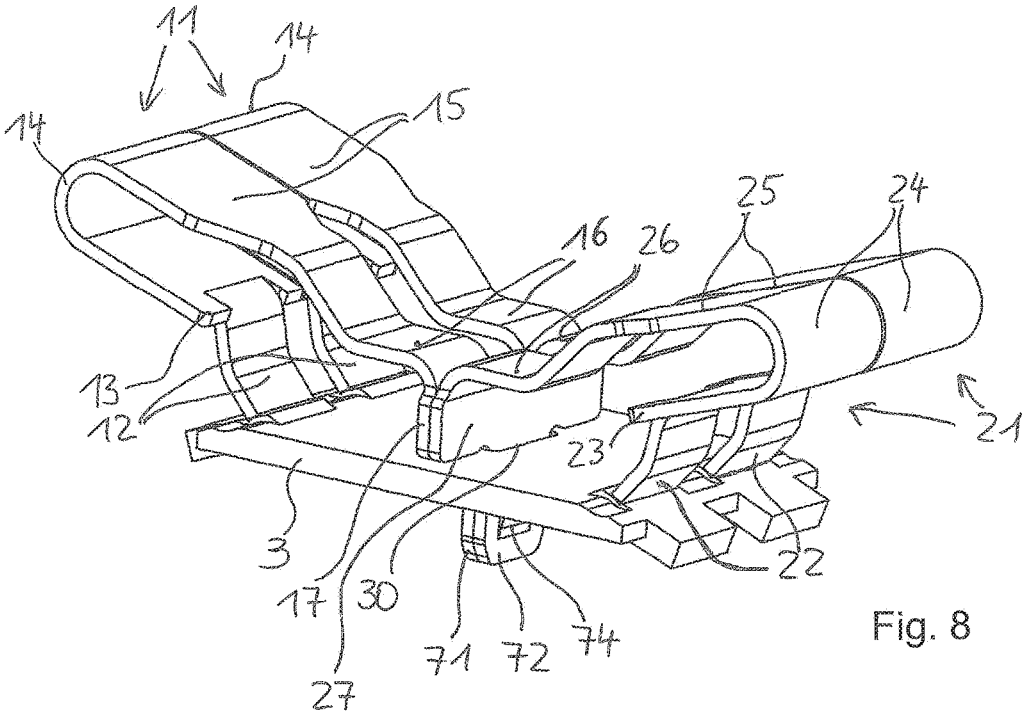
FIGS. 8 and 9 illustrate contact insert of the dual connecting terminal according to FIGS. 5 and 7 in various perspective views.
Figure 9:
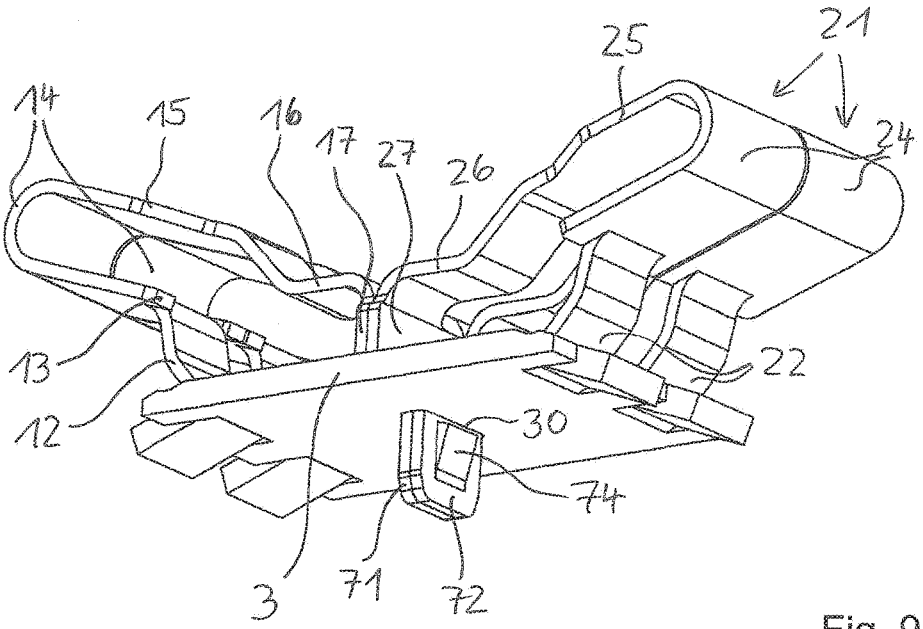

FIGS. 8 and 9 also illustrate this, in which the contact insert formed by the bus bar 3 and the clamping springs 11, 21 is shown separately. As can be seen, in each case two juxtaposed clamping springs 11 or 21 are connected to one another via a common vertical portion 17 or 27, which is continuous in width and mounted overhead on the bus bar 3. Each vertical portion 17, 27 has, for example at a central location, an end piece 71 or 72, which is inserted through the through-opening 30 of the bus bar 3, including the exposed material region 73 and 74 that serves for purposes of attaching.

The juxtaposed clamping springs 11 or 21 are operable independent of each other, i.e., they are not connected to each other in the other areas, beyond the common vertical portions 17 or 27, respectively.

The connecting terminal or dual connecting terminal 9 according to the invention may also be formed as a multi-clamp terminal in which more than two juxtaposed clamping points are present on each conductor insertion side, e.g., 3, 4, 5 or more. In this case, a common through-opening may be provided in the bus bar in each case for groups of clamping springs or all clamping springs for their attachment to the bus bar.

Figure 10:
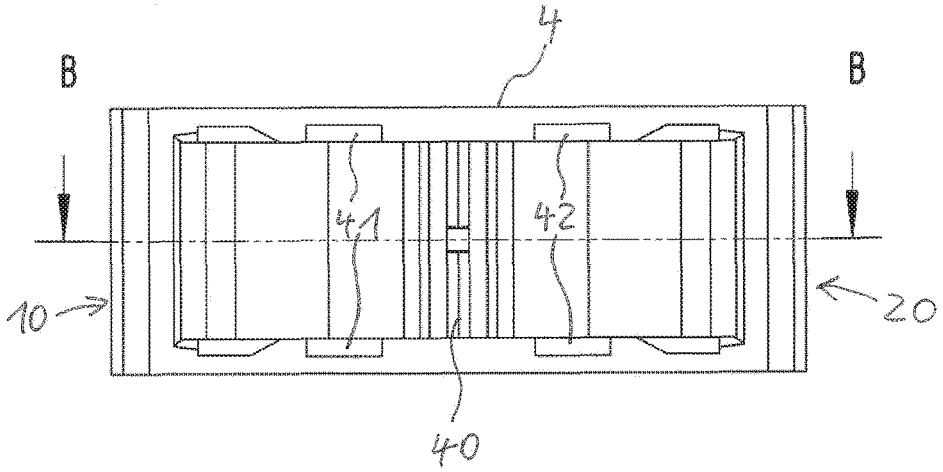
FIG. 10 is a view of the underside of the upper housing part of the dual connecting terminal.
Figure 11:
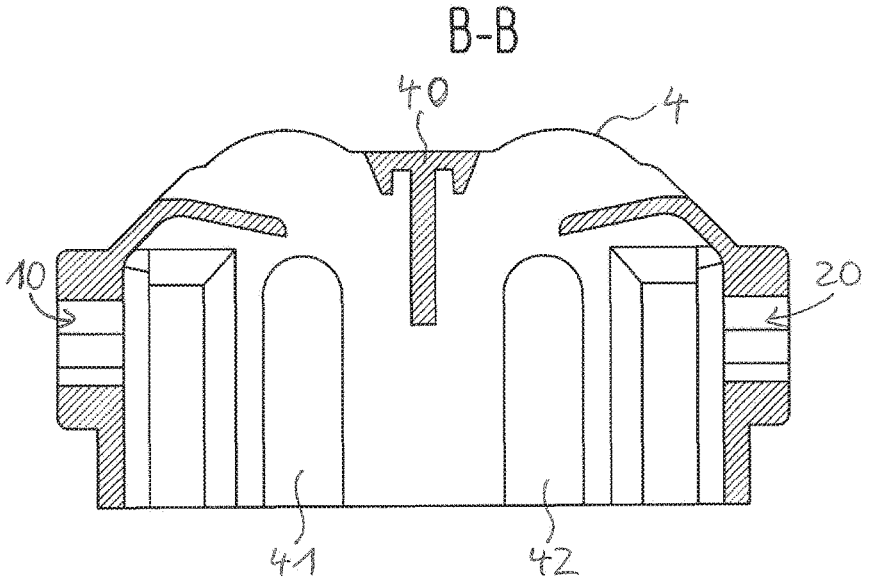
FIG. 11 is a cross-sectional view of the upper housing part of the dual connecting terminal according to the sectional plane B-B depicted in FIG. 10.

FIG. 10 shows a view of the underside of the upper housing part 4 of the dual connecting terminal 9, i.e., of the side to which the lower housing part is mounted. FIG. 11 shows the upper housing part 4 according to the sectional plane B-B of the dual connecting terminal shown in FIG. 10. Recognizable in particular are grooves 41, 42 arranged in the side walls for receiving and holding the operating levers 19, 29, which can be inserted in each case with their bearing shafts 61 from the bottom into the grooves 41, 42, in order to be supported and held at the upper end of the respective groove 41, 42. The respective grooves 41, 42 extend from the underside of the upper housing part 4 up to a position above the respective conductor insertion opening 10, 20.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connecting terminal for connecting at least two electrical conductors to one another, the connecting terminal comprising:

an insulating housing with at least one first and one second conductor insertion opening, the first and the second conductor insertion openings being arranged on mutually opposite sides of the insulating housing;

a first spring-force clamping connection for facilitating electrical contact with a first electrical conductor inserted through the first conductor insertion opening;

a second spring-force clamping connection for facilitating electrical contact with a second electrical conductor inserted through the second conductor insertion opening, the first and second spring-force clamping connection being arranged in the insulating housing; and a bus bar to electrically connect the first spring-force clamping connection to the second spring-force clamping connection, wherein the first spring-force clamping connection comprises at least a first clamping spring that has a clamping leg for clamping the first electrical conductor against a first clamping point of the bus bar and has a bearing leg for supporting the first clamping spring, wherein the second spring-force clamping connection has at least one second clamping spring that has a clamping leg for clamping the second electrical conductor against a second clamping point of the bus bar and has a bearing leg for supporting the second clamping spring, wherein the bus bar has at least one through-opening that is arranged between the first and the second clamping points, and wherein an extended end section of the bearing leg of the first clamping spring and an extended end section of the bearing leg of the second clamping spring are both hooked into a same one of the at least one through-opening of the bus bar.

2. The connecting terminal according to claim 1, wherein the bus bar is formed as a flat bus bar.

3. The connecting terminal according to claim 1, wherein the connecting terminal comprises a first operating lever for opening and closing the first spring-force clamping connection by loading the clamping leg of the first clamping spring when the first operating lever is actuated and/or comprises a second operating lever for opening and closing the second spring-force clamping connection by loading the clamping leg of the second clamping spring when the second operating lever is actuated.

4. The connecting terminal according to claim 1, wherein the first and/or the second clamping spring is formed in a loop shape, and wherein the respective bearing leg is bent in a direction of the bus bar with the extended end section of the respective clamping spring.

5. The connecting terminal according to claim 1, wherein the through-opening in the bus bar comprises a bushing.

6. The connecting terminal according to claim 1, wherein a portion of the bearing leg of the first clamping spring that is hooked into the through-opening engages behind the through-opening of the bus bar on a side of the bus bar facing away from the first clamping point and/or a portion of the bearing leg of the second clamping spring that is hooked into the through-opening engages behind the through-opening of the bus bar on a side of the bus bar facing away from the second clamping point.

7. The connecting terminal according to claim 1, wherein the bearing leg of the first clamping spring is supported on a side of the bus bar that faces the first clamping point and/or the bearing limbleq of the second clamping spring is supported on a side of the bus bar that faces the second clamping point.

8. The connecting terminal according to claim 1, wherein the first clamping spring and/or the second clamping spring is supported on the insulating housing.

9. The connecting terminal according to claim 1, wherein the connecting terminal comprises a plurality of adjacently arranged conductor insertion openings on a respective housing side of the insulating housing, each of which have spring-force clamping connections, each having a clamping spring that is associated with a conductor insertion opening, and wherein extended end sections of clamping springs arranged side by side are hooked into the same through-opening of the bus bar.

10. The connecting terminal according to claim 1, wherein the first clamping point and the second clamping point are provided at a same upper surface of the bus bar.

11. A connecting terminal for connecting at least two electrical conductors to one another, the connecting terminal comprising:

an insulating housing with at least one first and one second conductor insertion opening, the first and the second conductor insertion openings being arranged on mutually opposite sides of the insulating housing;

a first spring-force clamping connection for facilitating electrical contact with a first electrical conductor inserted through the first conductor insertion opening;

a second spring-force clamping connection for facilitating electrical contact with a second electrical conductor inserted through the second conductor insertion opening, the first and second spring-force clamping connection being arranged in the insulating housing; and a bus bar to electrically connect the first spring-force clamping connection to the second spring-force clamping connection, wherein the first spring-force clamping connection comprises at least a first clamping spring that has a clamping leg for clamping the first electrical conductor against a first clamping point of the bus bar and has a bearing leg for supporting the first clamping spring, wherein the second spring-force clamping connection has at least one second clamping spring that has a clamping leg for clamping the second electrical conductor against a second clamping point of the bus bar and has a bearing leg for supporting the second clamping spring, wherein the bus bar has at least one through-opening that is arranged between the first and the second clamping points, wherein an extended end section of the bearing leg of the first and/or second clamping spring is hooked into the through-opening of the bus bar, and wherein the first clamping spring contacts the second clamping spring in an area of their respective bearing legs.

12. A connecting terminal for connecting at least two electrical conductors to one another, the connecting terminal comprising:

an insulating housing with at least one first and one second conductor insertion opening, the first and the second conductor insertion openings being arranged on mutually opposite sides of the insulating housing;

a first spring-force clamping connection for facilitating electrical contact with a first electrical conductor inserted through the first conductor insertion opening;

a second spring-force clamping connection for facilitating electrical contact with a second electrical conductor inserted through the second conductor insertion opening, the first and second spring-force clamping connection being arranged in the insulating housing; and a bus bar to electrically connect the first spring-force clamping connection to the second spring-force clamping connection, wherein the first spring-force clamping connection comprises at least a first clamping spring that has a clamping leg for clamping the first electrical conductor against a first clamping point of the bus bar and has a bearing leg for supporting the first clamping spring, wherein the second spring-force clamping connection has at least one second clamping spring that has a clamping leg for clamping the second electrical conductor against a second clamping point of the bus bar and has a bearing leg for supporting the second clamping spring, wherein the bus bar has at least one through-opening that is arranged between the first and the second clamping points, wherein an extended end section of the bearing leg of the first and/or second clamping spring is hooked into the through-opening of the bus bar, and wherein the bearing leg of the first clamping spring forms a conductor stop during insertion of the first conductor into the insulating housing and/or the bearing leg of the second clamping spring forms a conductor stop of the second conductor when inserted into the insulating housing.

* * * * *